US008845455B2

(12) United States Patent
Ban et al.

(10) Patent No.: US 8,845,455 B2
(45) Date of Patent: Sep. 30, 2014

(54) GOLF CLUB HEAD AND METHOD OF MANUFACTURING THE SAME

(75) Inventors: Wataru Ban, Chichibu (JP); Kozue Wada, Minato-ku (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 54 days.

(21) Appl. No.: 13/599,656

(22) Filed: Aug. 30, 2012

(65) Prior Publication Data

US 2013/0109498 A1 May 2, 2013

(30) Foreign Application Priority Data

Oct. 27, 2011 (JP) ..... 2011-236054

(51) Int. Cl.
*A63B 53/04* (2006.01)

(52) U.S. Cl.
CPC ..... *A63B 53/047* (2013.01); *A63B 2053/0445* (2013.01); *A63B 53/0487* (2013.01); *A63B 2053/042* (2013.01); *A63B 53/0466* (2013.01)
USPC ..... 473/330; 473/331

(58) Field of Classification Search
CPC ..... A63B 2053/0416; A63B 2053/0445
USPC ..... 473/330, 331
See application file for complete search history.

(56) References Cited

U.S. PATENT DOCUMENTS 5,354,059 A * 10/1994 Stuff ..... 473/329
5,505,450 A * 4/1996 Stuff ..... 473/329
6,193,615 B1 * 2/2001 Hirota ..... 473/329
6,605,006 B2 * 8/2003 Mason ..... 473/252
6,793,864 B1 9/2004 Dewanjee et al.
6,981,923 B2 1/2006 Chappell
7,223,181 B2 5/2007 Dewanjee et al.
7,244,384 B1 7/2007 Dewanjee et al.
7,258,627 B2 8/2007 Chappell
7,594,862 B2 * 9/2009 Gilbert ..... 473/330
7,798,918 B2 9/2010 Ban et al.
7,905,798 B2 * 3/2011 Petersen et al. ..... 473/331
7,909,708 B2 * 3/2011 Gilbert ..... 473/330
7,922,601 B2 4/2011 Ban et al.
8,083,605 B2 * 12/2011 Franklin et al. ..... 473/251
8,167,738 B2 * 5/2012 Petersen et al. ..... 473/331
2003/0126734 A1 7/2003 Takeda
2004/0201133 A1 10/2004 Dewanjee et al.
2009/0036228 A1 2/2009 Ban et al.
2009/0082129 A1 3/2009 Ban et al.
2009/0209362 A1 * 8/2009 Petersen et al. ..... 473/331
2010/0029405 A1 * 2/2010 Gilbert ..... 473/331
2010/0190572 A1 * 7/2010 Vokey et al. ..... 473/331
2010/0210375 A1 * 8/2010 Petersen et al. ..... 473/331
2010/0287760 A1 11/2010 Nakano
2011/0224016 A1 * 9/2011 Gilbert ..... 473/331

FOREIGN PATENT DOCUMENTS

CA 2 364 776 A1 6/2002
JP 10-248974 A 9/1998
JP 2002-224250 A 8/2002

(Continued)

*Primary Examiner* — William Pierce
(74) *Attorney, Agent, or Firm* — Sughrue Mion, PLLC

(57) ABSTRACT

This invention provides a golf club head including a plurality of scorelines formed in its face surface and extending in the toe-to-heel direction. This golf club head includes a recessed portion for the cutting start of each scoreline, which is formed at one end or each of both ends of the scoreline in the longitudinal direction at a depth equal to or larger than that of the scoreline.

3 Claims, 17 Drawing Sheets

(56) References Cited

FOREIGN PATENT DOCUMENTS

| | | | |
|---|---|---|---|
| JP | 2003-199851 | A | 7/2003 |
| JP | 2009-028101 | A | 2/2009 |
| JP | 2009-034393 | A | 2/2009 |
| JP | 2009-066312 | A | 4/2009 |
| JP | 2010-057679 | A | 3/2010 |
| JP | 2010-131140 | A | 6/2010 |
| JP | 2010-263975 | A | 11/2010 |

* cited by examiner

FIG. 3E
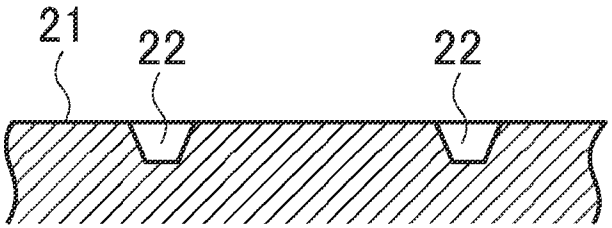
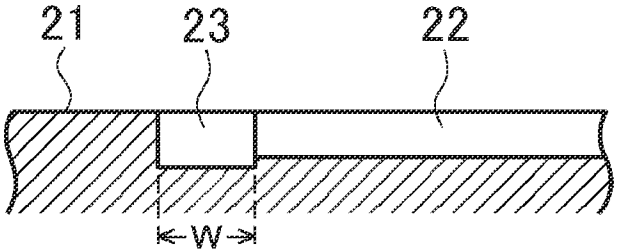
FIG. 3F
FIG. 3C
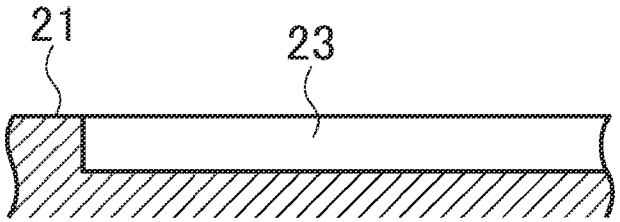
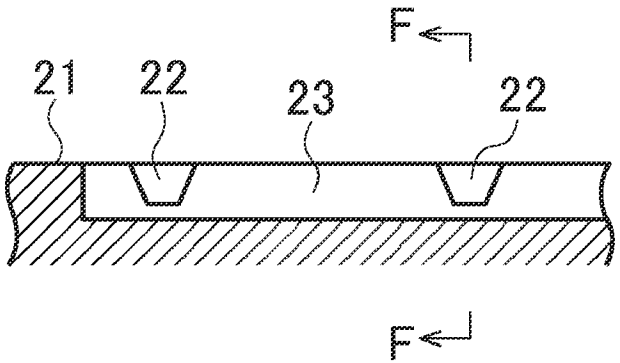
FIG. 3D

FIG. 4D
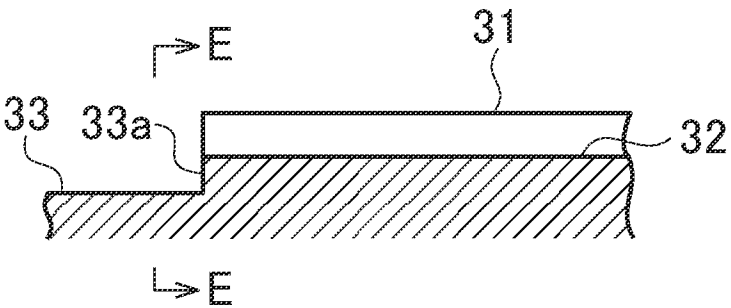
FIG. 4C
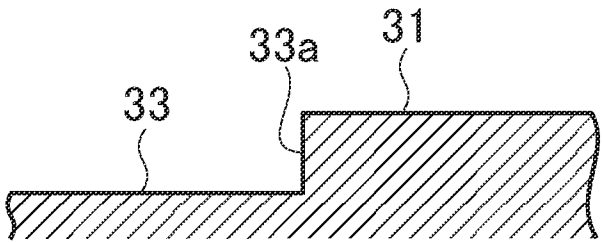
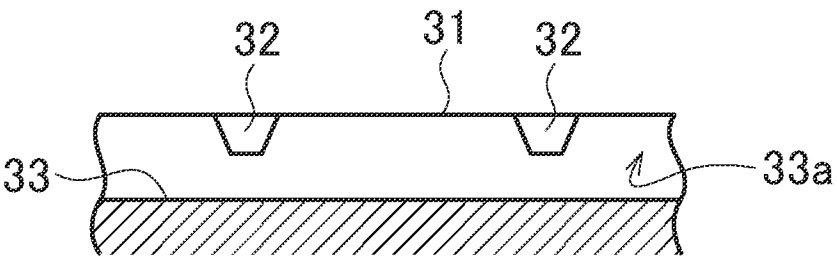
FIG. 4E

GOLF CLUB HEAD AND METHOD OF MANUFACTURING THE SAME

BACKGROUND OF THE INVENTION

1. Field of the Invention

The present invention relates to a golf club head including scorelines formed in its face surface, and a method of manufacturing the same.

2. Description of the Related Art

It is a common practice to form scorelines in the face surface of an iron type golf club head by cutting (for example, Japanese Patent Laid-Open Nos. 2010-57679, 2010-131140, and 2010-263975). FIG. 9 shows a method of forming scorelines (FIG. 5 in Japanese Patent Laid-Open No. 2010-57679) using an NC (Numerical Control) cutting machine. A golf club head 1 in which scorelines are to be formed is fixed to the NC cutting machine via a jig 2. The NC cutting machine includes a spindle 4 which is rotated about the Z-axis and has a lower end to which a cutting tool (end mill) 5 is attached.

After plane coordinates are set on the face surface of the golf club head 1, the spindle 4 is rotated to move the golf club head 1 and cutting tool 5 relative to each other in the direction (X-direction) in which scorelines are formed, thereby cutting the face surface so as to form groove-shaped scorelines in it. A large number of scorelines are formed so that they extend in the toe-to-heel direction and are vertically aligned to be parallel to each other.

FIG. 10 illustrates an example of the cross-sectional shape of scorelines 6 as described above (FIG. 4 in Japanese Patent Laid-Open No. 2010-57679). The scoreline 6 has an almost inverted trapezoidal cross-sectional shape and a flat bottom surface. Note that the corner edges at which the side surfaces of the scoreline 6 intersect with the face surface are rounded, and this arrangement complies with the golf rule (the so-called two-circle rule explained in paragraphs 0018 to 0021 of Japanese Patent Laid-Open No. 2010-57679).

To form scorelines 6 having flat bottom surfaces, the face surface is cut using an end mill 7 having a flat-topped surface 7*f* as its distal end surface, as shown in FIG. 10. More specifically, a hole is drilled in the face surface up to a predetermined depth using the end mill 7 upon pressing of the end mill 7 against the face surface, and then a groove is formed upon movement of the end mill 7 in the X-direction of FIG. 9, thereby forming scorelines 6 in the form of grooves having an equal depth.

In this case, the end mill 7 is tapered narrower to have a flat-topped surface with a small diameter as its distal end surface 7*f*, so a large load is imposed on the distal end of the end mill 7 upon its pressing against the face surface, and may quickly wear or damage the end mill 7. When the end mill 7 is very slowly pressed against the face surface, the above-mentioned problem can be avoided, but the cutting time is prolonged, thus degrading the productivity.

SUMMARY OF THE INVENTION

It is an object of the present invention to solve the above-mentioned conventional problem.

According to an aspect of the present invention, there is provided a golf club head including a plurality of scorelines formed in a face surface and extending in a toe-to-heel direction, the head comprising: a recessed portion for a cutting start of each of the scorelines, which is formed at one end or each of both ends of each of the scorelines in a longitudinal direction at a depth of not less than a depth of each of the scorelines.

According to another aspect of the present invention, there is provided a method of manufacturing a golf club head including a plurality of scorelines formed in a face surface and extending in a toe-to-heel direction, the method comprising the steps of: forming a recessed portion for a cutting start of each of the scorelines in a golf club head blank, in which the scorelines are to be formed, at a depth of not less than a depth of each of the scorelines; and inserting a distal end of an end mill into each of the recessed portions, and moving the end mill and the golf club head blank relative to each other, thereby forming each of the scorelines by cutting.

Further features of the present invention will become apparent from the following description of exemplary embodiments with reference to the attached drawings.

BRIEF DESCRIPTION OF THE DRAWINGS

FIGS. 3A to 3F are views for explaining a golf club head according to the second embodiment;

FIGS. 4A to 4E are views for explaining a golf club head according to the third embodiment;

DESCRIPTION OF THE EMBODIMENTS

Embodiments will be described below with reference to the accompanying drawings.

As an overview, in a method of manufacturing a golf club head according to each embodiment to be described below, cutting start recessed portions are formed in a golf club head blank in which scorelines are to be formed. The depth of the recessed portion is equal to or larger than that of the scoreline. The distal end of an end mill for scoreline cutting is disposed in the recessed portion, and the end mill and the club head blank are moved relative to each other in the longitudinal direction of the scoreline to be formed. Scorelines are formed in this way.

The recessed portion can be easily, quickly formed by drilling. At this time, when the recessed portion is formed by drilling, damage to the end mill can be prevented. Note that in this case, if the recessed portion is deeper than the scoreline, a step is formed at the boundary between the bottom surface of the recessed portion and that of the scoreline. The end mill for forming the recessed portion by drilling may be a drill blade or a ball mill having a semispherical distal end. The bottom surface of the recessed portion formed by drilling using a ball mill having a semispherical distal end has a U-shaped cross-section in the depth direction.

Also, the recessed portion may be formed by casting, forging, or laser processing. This obviates the need to form a recessed portion by drilling using, for example, an end mill.

The recessed portion may be formed as a depressed portion having a large area. In this case, after scorelines are formed, a plate is fixed to the depressed portion so as to have a front surface flush with the face surface. This plate can be firmly fixed to the golf club head by, for example, welding, brazing, or screwing. Note that the plate and the depressed portion can be provided with engagement portions which engage with each other, thereby increasing the plate fixing strength and appropriately positioning the plate.

First Embodiment

Figure 1A:
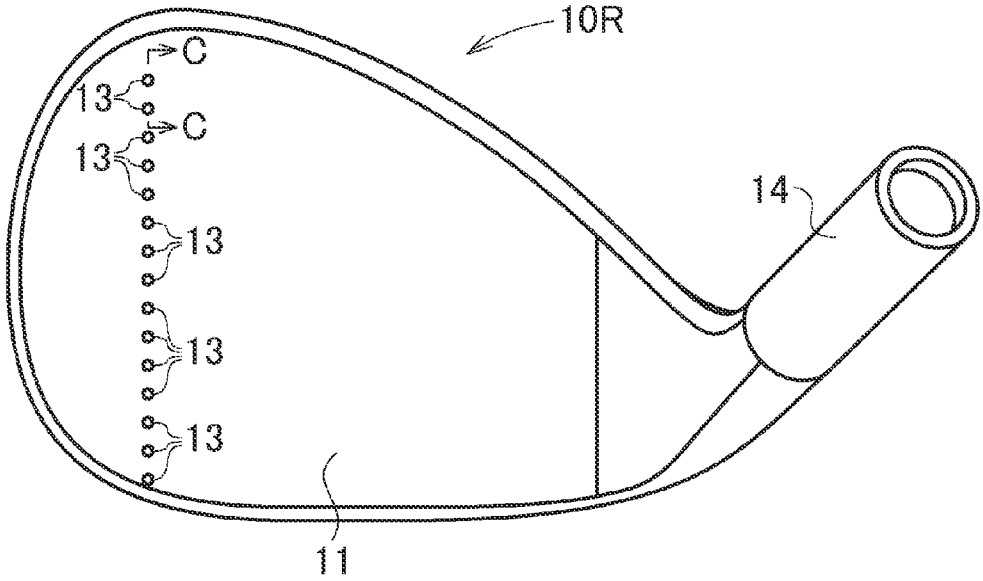
FIGS. 1A to 1F are views for explaining a golf club head according to the first embodiment.
Figure 1B:
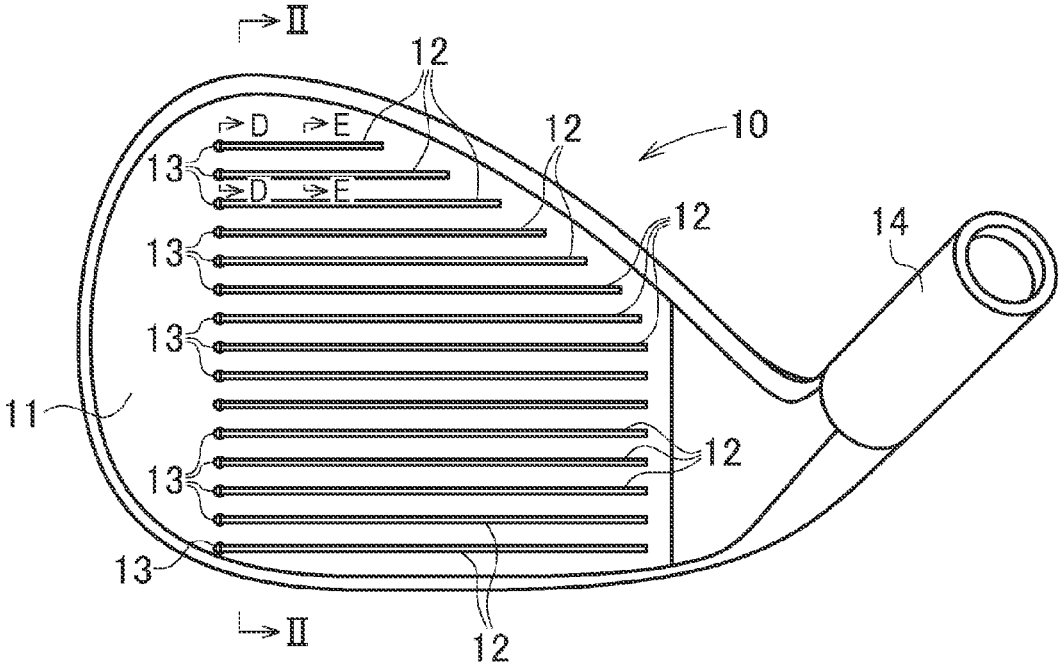
Figure 1E:
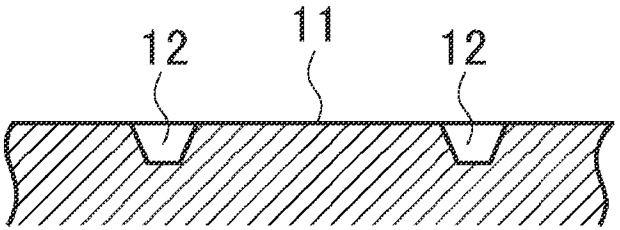
Figure 1F:
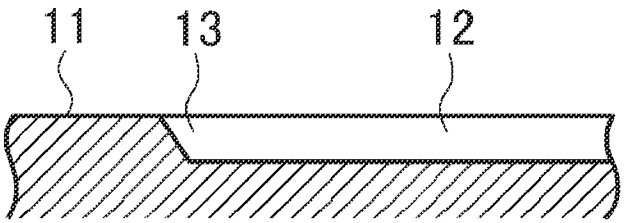
Figure 1C:
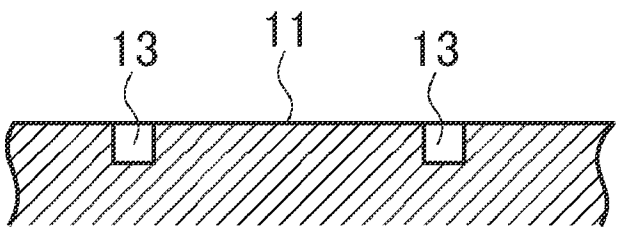
Figure 1D:
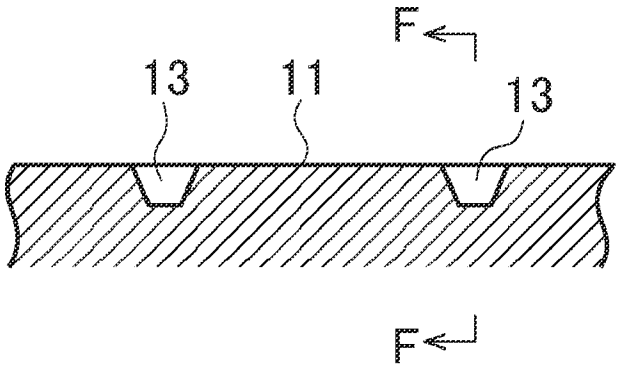
Figure 2A:
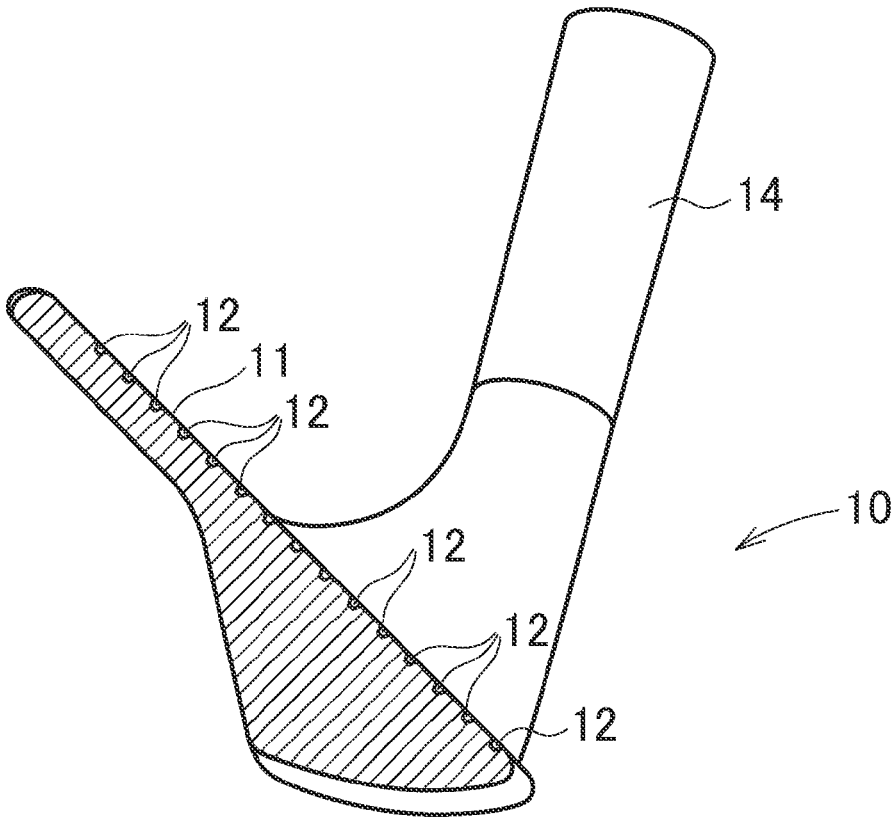
FIG. 2A is a sectional view taken along a line II-II in FIG. 1B.
Figure 2B:
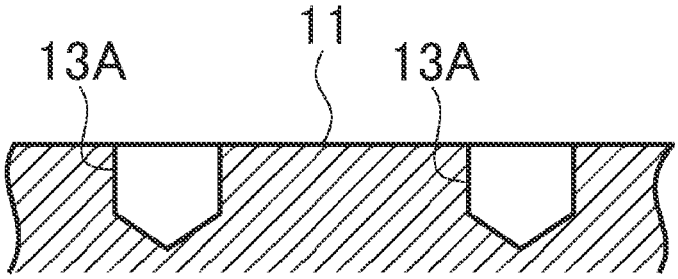
FIG. 2B is a sectional view in another mode.

FIG. 1A is a front view of a golf club head blank according to the first embodiment when viewed from a position directly in front of a face surface 11. FIG. 1B is a front view of a golf club head according to the first embodiment when viewed from a position directly in front of the face surface 11. FIG. 1C is an enlarged sectional view taken along a line C-C in FIG. 1A. FIGS. 1D and 1E are enlarged sectional views taken along lines D-D and E-E, respectively, in FIG. 1B. FIG. 1F is a sectional view taken along a line F-F in FIG. 1D. FIG. 2A is a sectional view taken along a line II-II in FIG. 1B. FIG. 2B is a sectional view showing another shape of a recessed hole.

A golf club head 10 shown in FIGS. 1A to 1F and 2A is an iron type golf club head, as shown in FIG. 1B, and includes a plurality of scorelines 12 formed in the face surface 11 parallel to each other in the toe-to-heel direction. A recessed hole 13 is formed on the toe side of each scoreline 12 as a cutting start recessed portion. The recessed holes 13 are aligned on one straight line, which runs in a direction (orthogonal direction) perpendicular to the scorelines 12.

Although the bottom surface of the recessed hole 13 is a flat surface parallel to the face surface 11, the present invention is not limited to this. The recessed hole 13 may have a perfect circular cylindrical shape having the same diameter in the depth direction, or a shape having a diameter slightly smaller on the bottom side than on the entrance side. The diameter and depth of the recessed hole 13 are set so that the distal end of a mill for forming the scoreline 12 by cutting can be inserted into the recessed hole 13 up to the depth of the scoreline 12 to be formed.

The scoreline 12 has an inverted trapezoidal cross-sectional shape with a width larger on the side of the face surface 11 than on the bottom side, and has a flat bottom surface. Although details are not shown, the scoreline 12 has rounded corner edges on the side of the face surface 11. A hosel 14 is formed on the heel side of the golf club head 10.

To manufacture a golf club head 10 as mentioned above, a golf club head blank 10R including neither scorelines 12 nor recessed holes 13 is manufactured by, for example, casting or forging in advance, as shown in FIG. 1A. Recessed holes 13 are drilled in the face surface 11 of the golf club head blank 10R using a drill, as shown in FIG. 1C. The recessed holes 13 can be easily, quickly formed by drilling using a hole drill without damaging the drill.

After each recessed hole 13 is formed by drilling, the distal end of a scoreline cutting end mill 7 (see FIG. 10) is inserted into the recessed hole 13 while cutting the face surface 11 so that the recessed hole 13 has a diameter which increases toward its entrance. The end mill 7 has a distal end surface 7*f* with a diameter smaller than that of the entrance of the recessed hole 13. Then, the end mill 7 is moved relative to the golf club head blank 10R in the longitudinal direction (the heel direction in this embodiment) of the scoreline 12 to be formed to form each scoreline 12 by cutting. This obviates the need for a process of pressing the distal end surface 7*f* of the end mill 7 against the face surface 11, thus suppressing wear of the end mill 7 and preventing damage to it. Upon cutting of the face surface 11 so that the recessed hole 13 has a diameter which increases toward its entrance, the scoreline 12 has a width larger on the entrance side than on the bottom side.

Note that the end mill 7 need only be moved relative to the golf club head blank 10R, so the end mill 7 itself may be moved or the golf club head blank 10R may be moved. The same applies to the embodiments to be described later.

In this way, each scoreline 12 can be efficiently formed to manufacture a golf club head 10 with high manufacturing efficiency.

Note that the recessed holes 13 may be formed by laser processing or formed simultaneously with casting or forging of the golf club head blank 10R.

Figure 13:
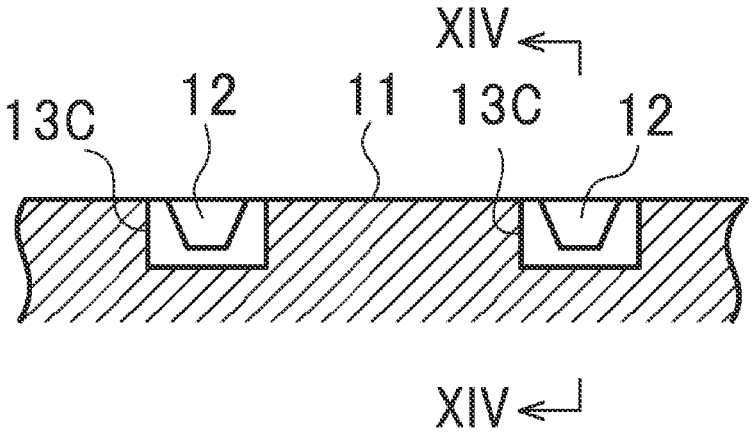
FIG. 13 is a sectional view showing another shape of a recessed hole 13.
Figure 14:
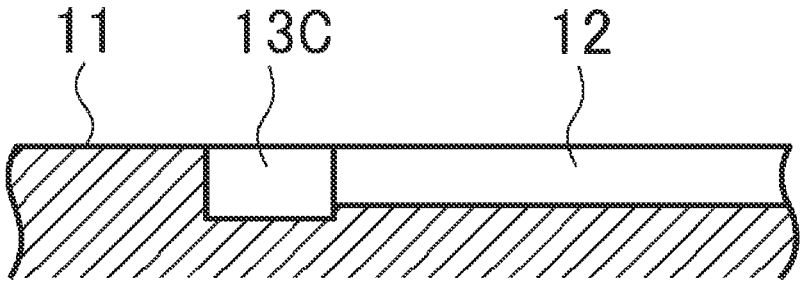
FIG. 14 is a sectional view taken along a line XIV-XIV in FIG. 13.

The recessed hole 13 may be substituted with a recessed hole 13C having a diameter larger than that of the scoreline 12, as shown in FIG. 13. Alternatively, the recessed hole 13 may be substituted with a recessed hole 13A having a circular conical bottom surface, as shown in FIG. 2B. Note that FIGS. 2B and 13 are sectional views of the same portion as in FIG. 1D. FIG. 14 is a sectional view taken along a line XIV-XIV in FIG. 13.

Second Embodiment

Figure 3A:
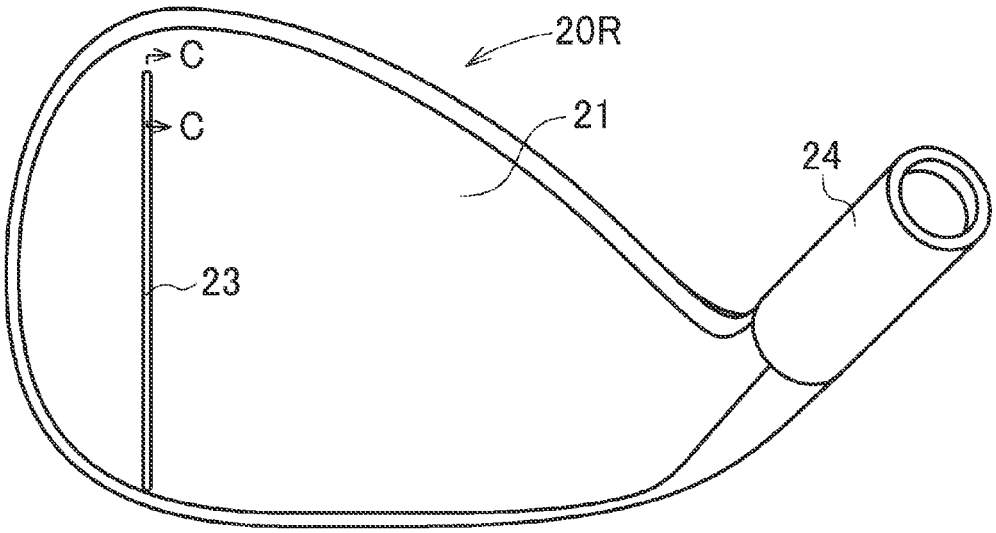
Figure 3B:
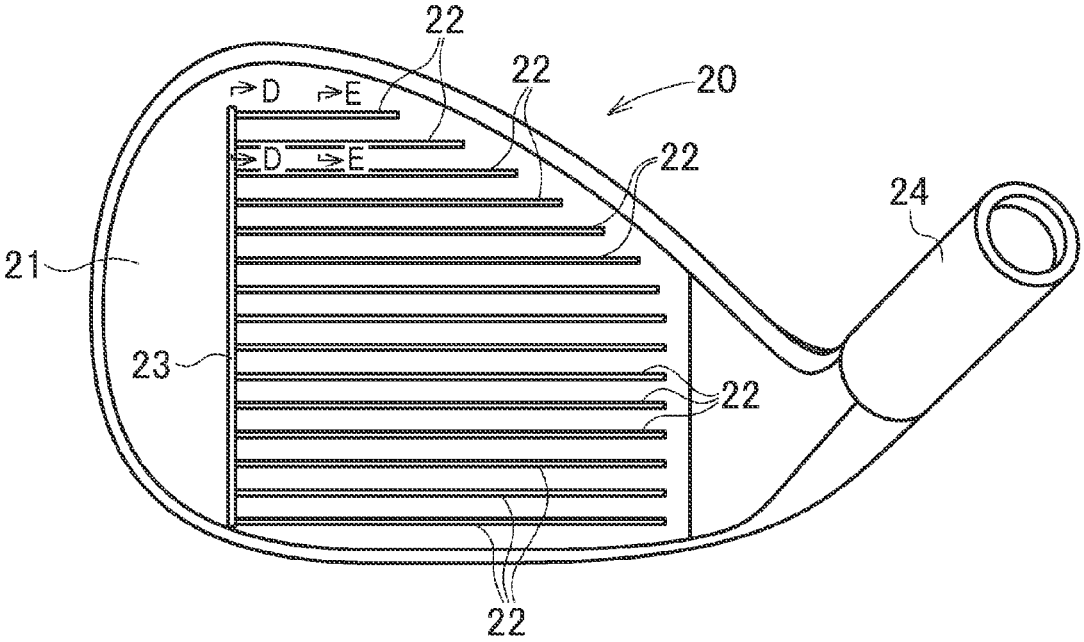

FIG. 3A is a front view of a golf club head blank 20R according to the second embodiment when viewed from a position directly in front of a face surface 21. FIG. 3B is a front view of a golf club head 20 according to the second embodiment when viewed from a position directly in front of the face surface 21. FIG. 3C is an enlarged sectional view taken along a line C-C in FIG. 3A. FIGS. 3D and 3E are enlarged sectional views taken along lines D-D and E-E, respectively, in FIG. 3B. FIG. 3F is a sectional view taken along a line F-F in FIG. 3D.

The golf club head 20 is an iron type golf club head, as shown in FIG. 3B, and includes a plurality of scorelines 22 formed in the face surface 21 parallel to each other in the toe-to-heel direction. A recessed groove 23 to serve as a cutting start recessed portion vertically extends across the plurality of scorelines 22 so as to connect their toe-side end portions to each other. The recessed groove 23 extends in a direction (orthogonal direction) perpendicular to the scorelines 22.

The recessed groove 23 has a quadrangular (rectangular or square) cross-sectional shape along the toe-to-heel direction, as shown in FIG. 3F. The recessed groove 23 has a width W (FIG. 3F) in the toe-to-heel direction, which is larger than the width of the scoreline 22 on the side of the face surface 21, and a depth larger than that of the scoreline 22.

The scoreline 22 has an inverted trapezoidal cross-sectional shape with a width larger on the side of the face surface 21 than on the bottom side, and has a flat bottom surface. Although details are not shown, the scoreline 22 has rounded corner edges on the side of the face surface 21. A hosel 24 is formed on the heel side of the golf club head 20.

Figure 10:
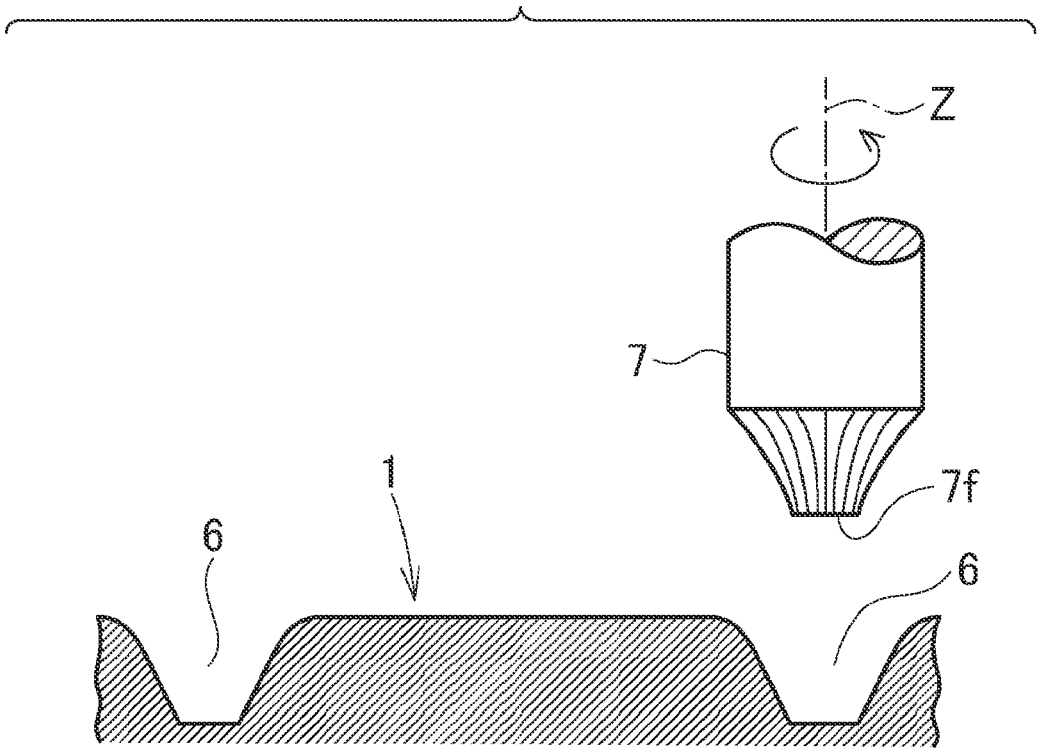
FIG. 10 PRIOR ART
FIG. 10 is a sectional view showing scorelines and a method of forming the same according to the related art.

To manufacture a golf club head 20 as mentioned above, a golf club head blank 20R including neither scorelines 22 nor recessed groove 23 is manufactured by, for example, casting or forging in advance, as shown in FIG. 3A. A recessed groove 23 is drilled in the face surface 21 of the golf club head blank 20R using an end mill. The recessed groove 23 has a quadrangular cross-sectional shape, and is therefore formed by drilling using an end mill having a diameter equal across the length from the proximal end side to the distal end side. Also, the recessed groove 23 has a width W larger than that of the scoreline 22, and the end mill has a diameter larger than that of the distal end of a conventional scoreline drilling end mill 7 (FIG. 10). Hence, even when the end mill is pressed against the face surface 21, no load is imposed on the distal end of the end mill, thus considerably suppressing wear of the end mill and preventing damage to it. This makes it possible to drill a recessed groove 23 in the face surface 21 upon pressing of the end mill against the face surface 21 at high speed, thereby efficiently forming the recessed groove 23. The recessed groove 23 may have a width smaller than that of the scoreline 22 as long as the former has a width larger than that of the bottom portion.

After the recessed groove 23 is formed, the distal end of the scoreline cutting end mill 7 (see FIG. 10) is inserted into the recessed groove 23. Then, the end mill 7 is moved relative to the golf club head blank 20R in the heel direction to form each scoreline 22 by cutting. This obviates the need for a process of pressing a distal end surface 7*f* of the end mill 7 against the face surface 21, thus suppressing wear of the end mill 7 and preventing damage to it.

In this way, each scoreline 22 can be efficiently formed to manufacture a golf club head 20 with high manufacturing efficiency.

Note that the recessed groove 23 may be formed by laser processing or formed simultaneously with casting or forging of the golf club head blank 20R.

Third Embodiment

Figure 4A:
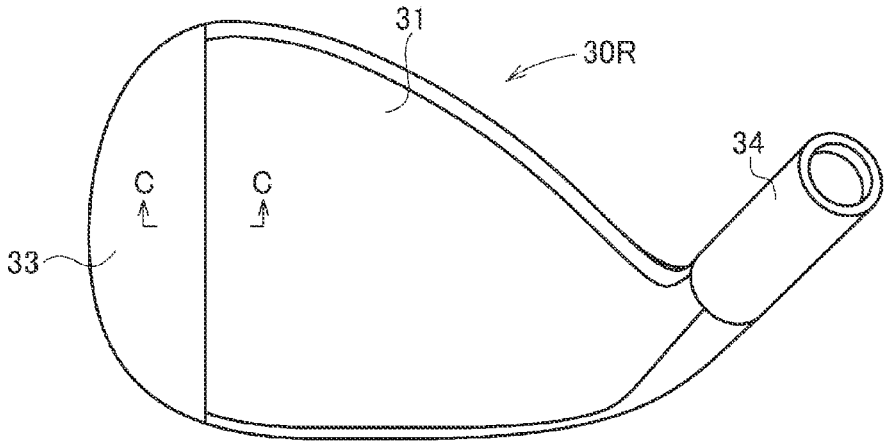
Figure 4B:
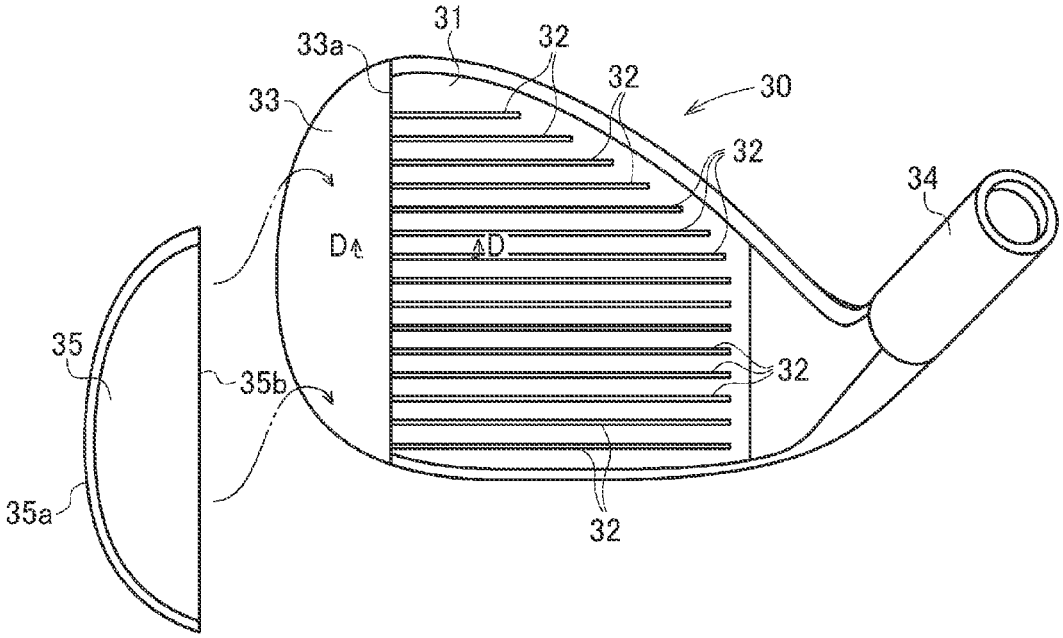
Figure 5:
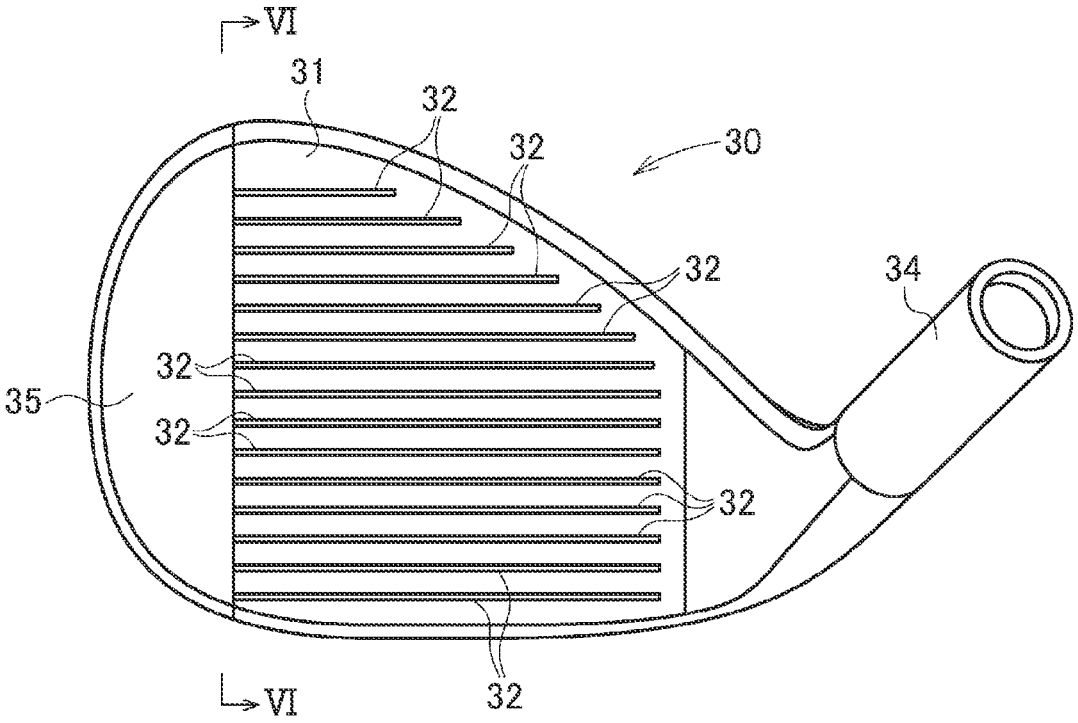
FIG. 5 is a front view of the golf club head according to the third embodiment.
Figure 6:
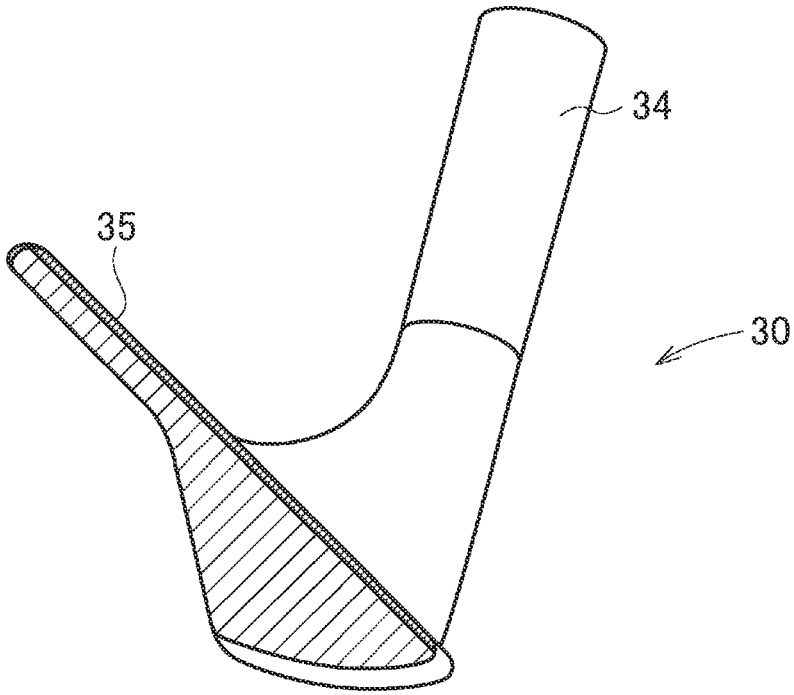
FIG. 6 is a sectional view taken along a line VI-VI in FIG. 5.

FIG. 4A is a front view of a golf club head blank 30R according to the third embodiment when viewed from a position directly in front of a face surface 31. FIG. 4B is a front view of a golf club head 30 according to the third embodiment when viewed from a position directly in front of the face surface 31. FIG. 4C is an enlarged sectional view taken along a line C-C in FIG. 4A. FIG. 4D is an enlarged sectional view taken along a line D-D in FIG. 4B. FIG. 4E is a sectional view taken along a line E-E in FIG. 4D. FIG. 5 is a front view of the golf club head 30 when viewed from a position directly in front of the face surface 31. FIG. 6 is a sectional view taken along a line VI-VI in FIG. 5.

The golf club head 30 is an iron type golf club head, as shown in FIG. 4B, and includes a plurality of scorelines 32 formed in the face surface 31 parallel to each other in the toe-to-heel direction. A depressed portion 33 is formed on the toe side of each scoreline 32 as a cutting start recessed portion. The depressed portion 33 is formed in the entire region on the toe side with respect to a stepped portion 33*a* which connects the toe-side ends of the scorelines 32 to each other. The stepped portion 33*a* extends in a direction perpendicular to the scorelines 32. The depressed portion 33 has a bottom surface parallel to the face surface 31.

The scoreline 32 has an inverted trapezoidal cross-sectional shape with a width larger on the side of the face surface 31 than on the bottom side, and has a flat bottom surface. Although details are not shown, the scoreline 32 has rounded corner edges on the side of the face surface 31. A hosel 34 is formed on the heel side of the golf club head 30.

To manufacture a golf club head 30 as mentioned above, a golf club head blank 30R including a depressed portion 33 but not including scorelines 32 is manufactured by, for example, casting or forging in advance, as shown in FIG. 4A.

Then, a scoreline cutting end mill 7 (see FIG. 10) is disposed so as to abut its distal end against the stepped portion 33*a*, and is moved relative to the golf club head blank 30R in the heel direction to form each scoreline 32 by cutting. This obviates the need for a process of pressing a distal end surface 7*f* of the end mill 7 against the face surface 31, thus suppressing wear of the end mill 7 and preventing damage to it. Also, since the depressed portion 33 is formed in advance, the time taken to form the scorelines 32 by cutting can be shortened.

A plate 35 having a shape conforming to the depressed portion 33 is engaged with the depressed portion 33, and fixed to the golf club head 30 by, for example, welding, brazing, or screwing. The fixed plate 35 has a front surface flush with the face surface 31. Note that the plate 35 is a thin plate member which has an almost chord shape and includes an arcuated side 35*a* along the outer periphery of the golf club head 30 on the toe side, and a chord side 35*b*. The chord side 35*b* abuts against the stepped portion 33*a*, and the plate 35 is engaged with and fixed to the depressed portion 33 so that the arcuated side 35*a* fits with the toe-side outer peripheral edge of the golf club head 30.

In this embodiment as well, a golf club head 30 can be manufactured with high manufacturing efficiency.

Note that the depressed portion 33 may be formed by cutting.

Other Embodiments

Figure 7:
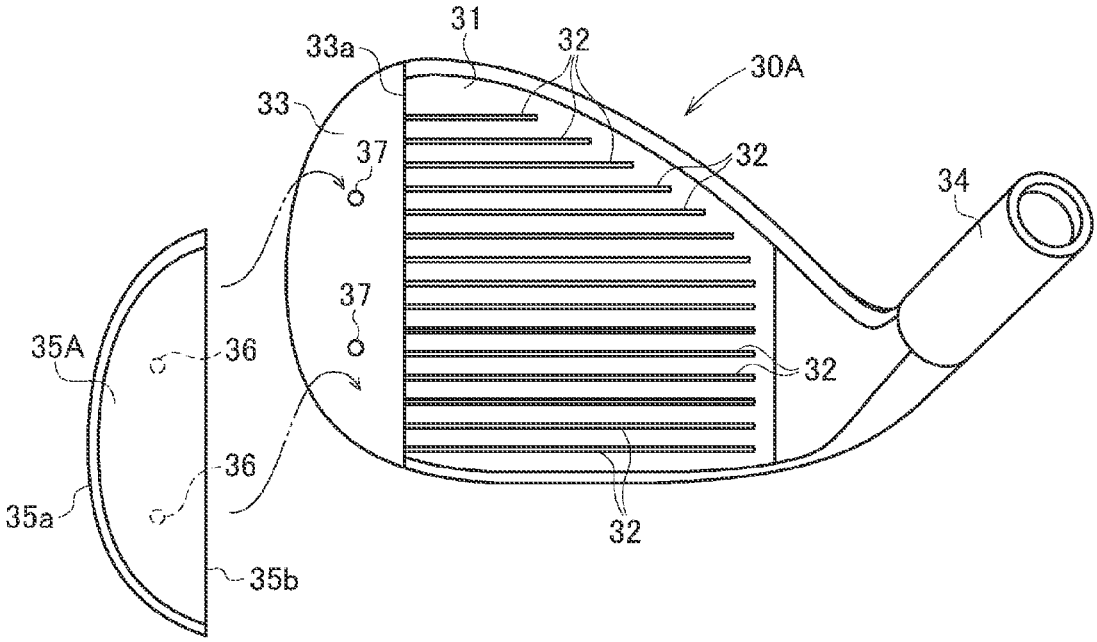
FIG. 7 is a view for explaining a golf club head according to the fourth embodiment.

In the above-mentioned third embodiment, an engagement portion which engages the plate with the depressed portion may be formed. FIG. 7 illustrates an example of this case, wherein engagement projections 36 are formed on the lower surface of a plate 35A, and engagement holes 37 are formed in a depressed portion 33. The engagement projections 36 engage with the engagement holes 37 while the plate 35A engages with the depressed portion 33, so the plate 35A is fixed to a golf club head 30A by, for example, welding, brazing, or screwing. Other arrangements of the golf club head 30A are the same as those of the above-mentioned golf club head 30 shown in FIGS. 4A to 4E, 5 and 6, and the same reference numerals as in FIGS. 4A to 4E, 5 and 6 denote the same parts in FIG. 7.

Note that the shapes and numbers of engagement projections and engagement holes may be different from those shown in FIG. 7. Also, engagement projections may be formed in the depressed portion 33, and engagement holes may be formed in the plate 35A.

Figure 8:
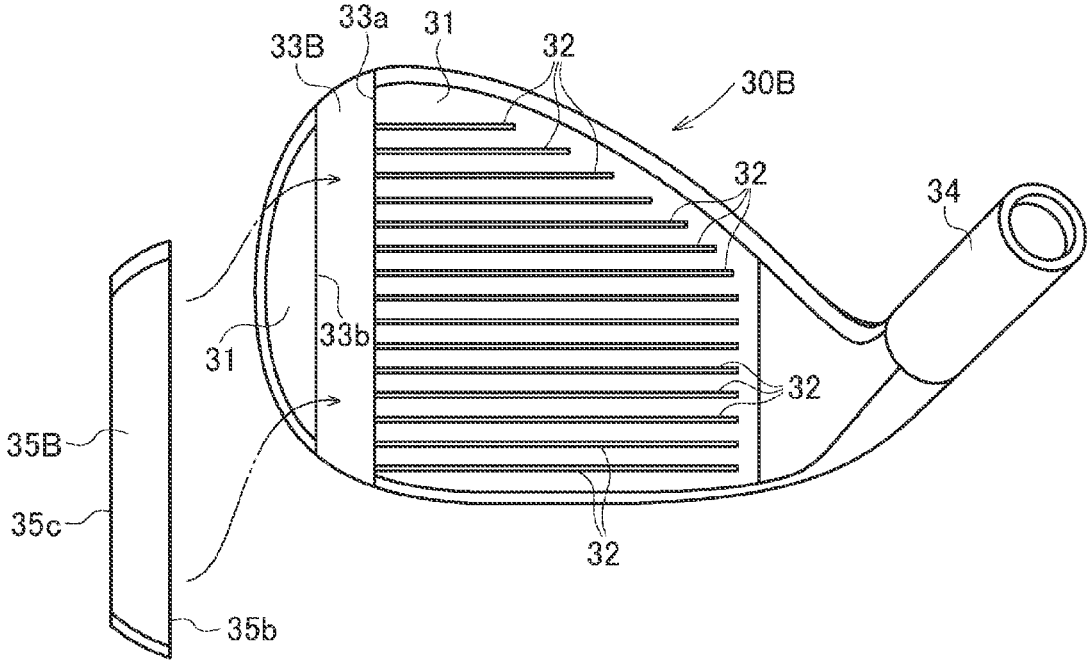
FIG. 8 is a view for explaining a golf club head according to the fifth embodiment.
Figure 9:
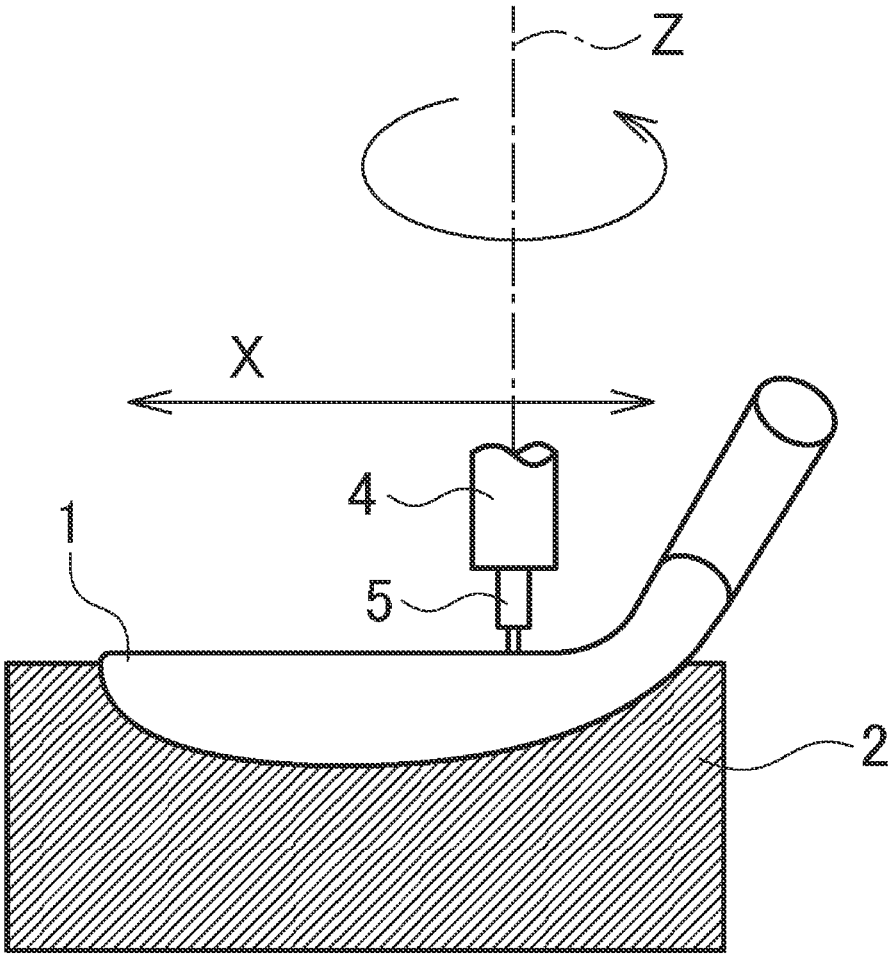
FIG. 9 PRIOR ART
FIG. 9 is a sectional view showing a method of forming scorelines according to the related art.

Although the depressed portion 33 is formed in the entire region of the face portion on the toe side with respect to the stepped portion 33*a* in the above-mentioned third embodiment, it may be formed in a region smaller than this entire region. FIG. 8 illustrates an example of this case, wherein a depressed portion 33B is formed in a vertically extending band shape. That is, the depressed portion 33B is formed between stepped portions 33*a* and 33*b* as a wide groove-shaped portion depressed from a face surface 31. Although the stepped portion 33*b* extends parallel to the stepped portion 33*a*, the present invention is not limited to this. A plate 35B is formed by a band-shaped thin plate having a shape conforming to the depressed portion 33B. The plate 35B is engaged with the depressed portion 33B, so that a side 35*b* fits with the stepped portion 33*a* and a side 35*c* fits with the stepped portion 33*b*, and is fixed to a golf club head 30B by, for example, welding, brazing, or screwing. Other arrangements of the golf club head 30B are the same as those of the golf club head 30, and the same reference numerals as in FIGS. 4A to 4E, 5 and 6 denote the same parts in FIG. 8. Note that an engagement portion including engagement projections and engagement holes which engage the plate 35B with the depressed portion 33B may be formed in the golf club head 30B, as in FIG. 7.

The depressed portion 33B may be formed during casting or forging of a golf club head blank or formed by cutting.

Figure 11A:
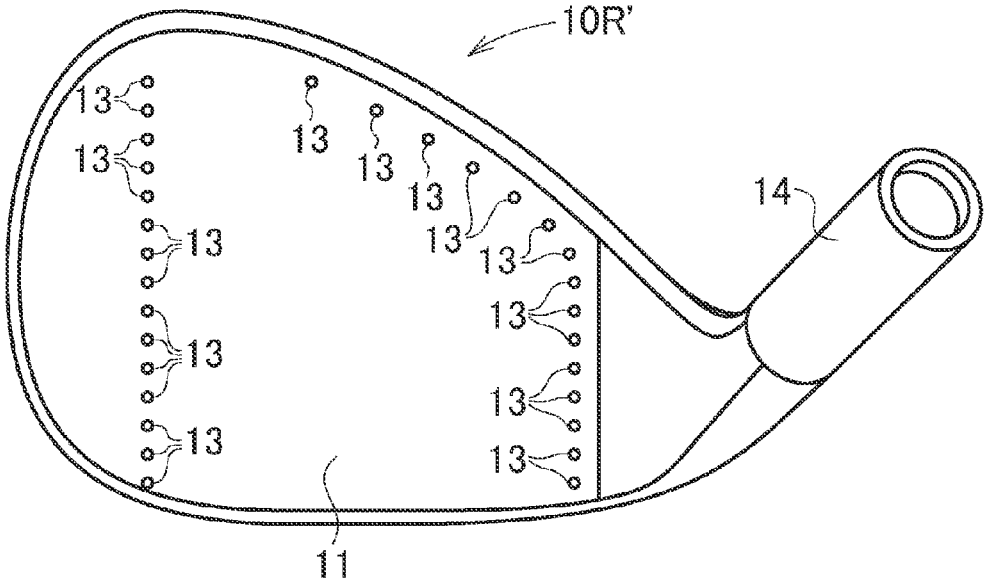
FIGS. 11A and 11B are views for explaining a golf club head according to another embodiment.
Figure 11B:
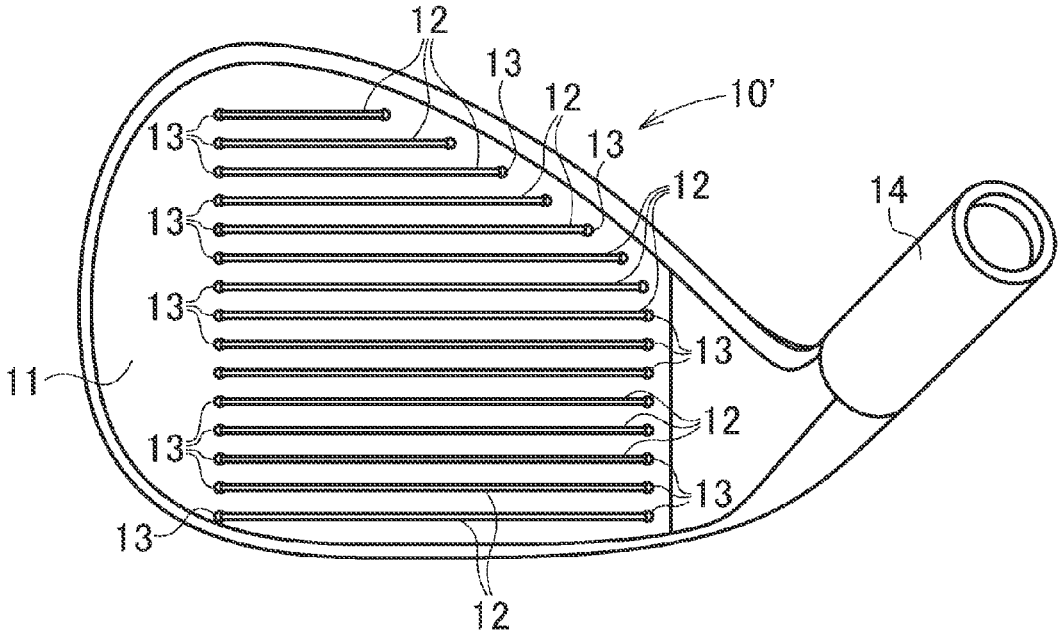
Figure 12A:
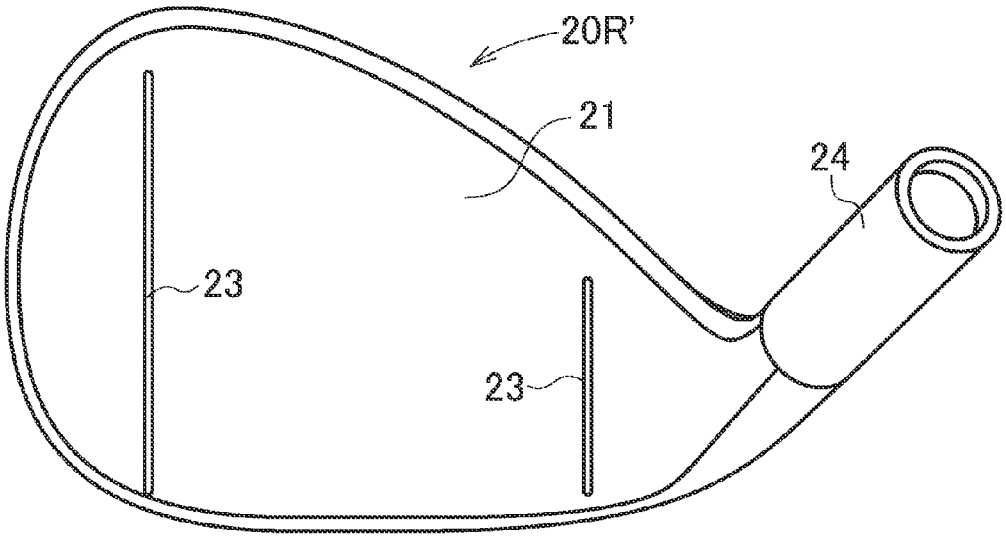
FIGS. 12A and 12B are views for explaining a golf club head according to still another embodiment.
Figure 12B:
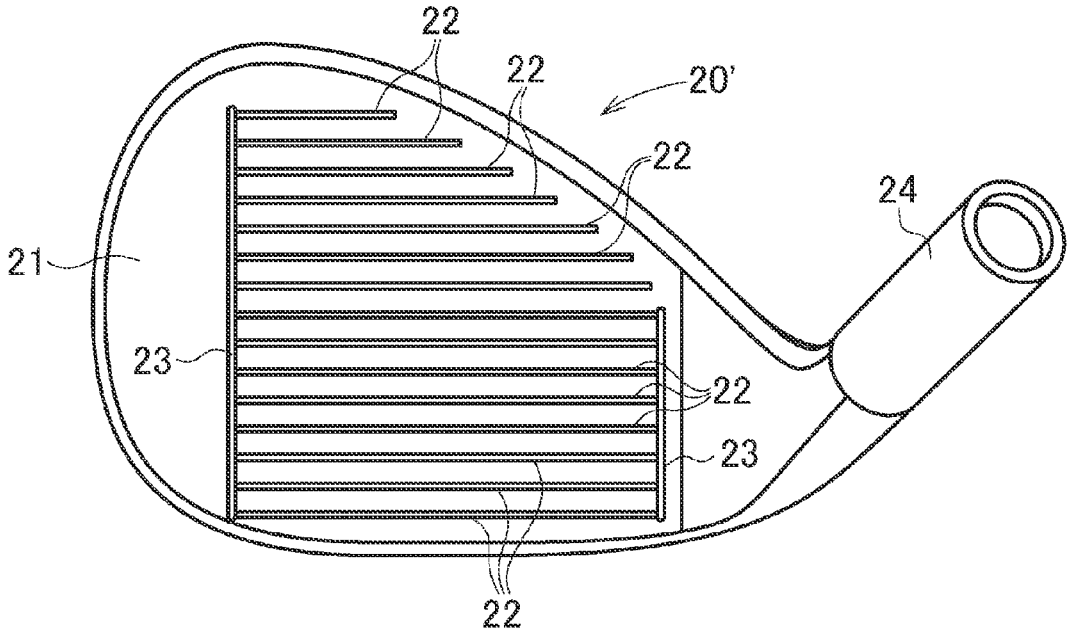

The above-mentioned embodiments merely provide examples of the present invention, and the present invention may be practiced in embodiments other than those shown in the accompanying drawings. Although the recessed holes 13 and recessed groove 23 are formed only on the toe side in the above-mentioned embodiments, they may be formed on both the toe and heel sides. FIG. 11A shows a golf club head blank 10R' including recessed holes 13 formed on both the toe and heel sides, and FIG. 11B shows a golf club head 10' manufactured by forming scorelines 12 in the golf club head blank 10R'. Other arrangements in FIGS. 11A and 11B are the same as in FIGS. 1A to 1F, and the same reference numerals as in FIGS. 1A to 1F denote the same parts in FIGS. 11A and 11B. FIG. 12A shows a golf club head blank 20R' including recessed grooves 23 formed on both the toe and heel sides, and FIG. 12B shows a golf club head 20' manufactured by forming scorelines 22 in the golf club head blank 20R'. Other arrangements in FIGS. 12A and 12B are the same as in FIGS. 3A to 3F, and the same reference numerals as in FIGS. 3A to 3F denote the same parts in FIGS. 12A and 12B.

The present invention is applicable not only to an iron type golf club head but also to, for example, a utility type golf club head, a putter type golf club head, and a wood type golf club head. To remove burrs formed upon processing, the groove edges (groove corners) may be rounded later.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-236054, filed Oct. 27, 2011, which is hereby incorporated by reference herein in its entirety.

What is claimed is:

1. A method of manufacturing a golf club head including a plurality of scorelines formed in a face surface and extending in a toe-to-heel direction, comprising:

forming a recessed portion for a cutting start of each of the scorelines in a golf club head blank, in which the scorelines are to be formed, at a depth greater than a depth of each of the scorelines; and inserting a distal end of an end mill into the recessed portion, and moving at least one of the end mill or the golf club head blank relative to the other, thereby forming each of the scorelines by cutting.

2. The method according to claim 1, wherein the recessed portion includes a depressed portion which is formed on a toe side of the face surface and recedes from the face surface, and the manufacturing method further comprises the step of fixing the plate to the depressed portion.

3. A method of manufacturing a golf club head including a plurality of scorelines formed in a face surface and extending in a toe-to-heel direction, comprising:

forming recessed portions, each recessed portion being for a cutting start of one of the scorelines in a golf club head blank, in which the scorelines are to be formed, at a depth greater than a depth of each of the scorelines; and inserting a distal end of an end mill into each of the recessed portions, and moving at least one of the end mill or the golf club head blank relative to the other, thereby forming each of the scorelines by cutting.

* * * * *